US010034526B2

(12) United States Patent
Gamblin et al.

(10) Patent No.: US 10,034,526 B2
(45) Date of Patent: Jul. 31, 2018

(54) LASER RANGEFINDER HOLDER

(71) Applicant: Monument Golf LLC, Scottsdale, AZ (US)

(72) Inventors: Chad Gamblin, Scottsdale, AZ (US); Jeff Eggen, Mesa, AZ (US)

(73) Assignee: Monument Golf LLC, Scottsdale, AZ (US)

( * ) Notice: Subject to any disclaimer, the term of this patent is extended or adjusted under 35 U.S.C. 154(b) by 51 days.

(21) Appl. No.: 15/271,950

(22) Filed: Sep. 21, 2016

(65) Prior Publication Data

US 2017/0150794 A1 Jun. 1, 2017

Related U.S. Application Data

(60) Provisional application No. 62/238,899, filed on Oct. 8, 2015.

(51) Int. Cl.

| | |
|---|---|
| ***A47G 1/17*** | (2006.01) |
| ***A45C 13/00*** | (2006.01) |
| ***A45F 5/02*** | (2006.01) |
| ***A45C 11/00*** | (2006.01) |

(52) U.S. Cl.

CPC ..... *A45C 13/002* (2013.01); *A45C 11/00* (2013.01); *A45F 5/021* (2013.01); *A45C 2011/003* (2013.01)

(58) Field of Classification Search

USPC ... 248/683, 104, 205.2, 206.5, 218.4, 309.4, 248/499

See application file for complete search history.

(56) References Cited

U.S. PATENT DOCUMENTS

| | | | | |
|---|---|---|---|---|
| 3,007,568 A | | 11/1961 | Kurland | |
| 4,826,059 A | * | 5/1989 | Bosch | A45C 11/24 206/350 |
| 4,903,932 A | * | 2/1990 | Stewart, Jr. | A45F 5/00 224/267 |
| 5,460,305 A | | 10/1995 | Ahearn | |
| 6,015,132 A | * | 1/2000 | Belle | F16M 13/02 248/205.3 |

(Continued)

OTHER PUBLICATIONS

Amazon, Magnelex Best Magnetic Wristband for Holding Tools, Screws,Nails, Bolts, Drilling Bits, https://www.amazon.com/Magnelex-Magnetic-Wristband-Christmas-Relatives/dp/B00R1UWNDE/ref=sr_1_1? s=hi&ie=UTF8&qid=1501351827&sr=1-1-spons&keywords=magnelex+best+magnetic+wristband&psc=1, downloaded Jul. 29, 2017.

(Continued)

*Primary Examiner* — Terrell L McKinnon
*Assistant Examiner* — Michael McDuffie
(74) *Attorney, Agent, or Firm* — Schmeiser, Olsen & Watts LLP

(57) ABSTRACT

Described is a laser rangefinder holder that is used to couple a laser rangefinder to a solid surface so the laser rangefinder can be easily used during sporting activities. The laser rangefinder holder includes a rangefinder wrap and a buckle ring removeably coupled to the rangefinder wrap. The rangefinder wrap wraps around the laser rangefinder, using the buckle to couple the laser rangefinder holder to the laser rangefinder. One or more magnets coupled to the rangefinder wrap are used to removeably couple the laser rangefinder holder and the laser rangefinder held in the laser rangefinder holder to a metal surface.

16 Claims, 10 Drawing Sheets

(56) References Cited

U.S. PATENT DOCUMENTS 6,138,882 A * 10/2000 Buettner ..... A45C 13/00 190/102
6,311,946 B1 * 11/2001 Hoffman ..... F16M 13/02 248/205.2
6,587,022 B1 * 7/2003 Devine ..... A45F 5/00 206/350
6,945,503 B2 * 9/2005 Cohen ..... G09F 7/04 224/183
7,896,297 B1 * 3/2011 Simone ..... A61J 9/0661 248/102
8,696,112 B1 * 4/2014 Vaught ..... G02C 3/02 2/10
9,115,969 B2 * 8/2015 Goodwin ..... F42B 39/02
2006/0027613 A1 * 2/2006 Chang ..... A45C 15/00 224/183
2010/0064544 A1 * 3/2010 Luong ..... A47L 23/205 34/239
2011/0278407 A1 * 11/2011 Osiecki ..... B60R 13/005 248/206.5
2012/0097720 A1 * 4/2012 Lee ..... A47G 25/12 224/407
2012/0181311 A1 * 7/2012 Stevens, IV ..... A41F 9/002 224/197
2012/0280094 A1 * 11/2012 Post ..... A47G 25/0614 248/205.2
2014/0367438 A1 * 12/2014 Hunt ..... A45F 5/14 224/567

OTHER PUBLICATIONS

Amazon, Fastcap Pro Hold Pro Hold Strap-on Magnetic Holder, https://www.amazon.com/Fastcap-PRO-HOLD-strap-magnetic/dp/B000GFOXQG/ref=sr_1_1?s=hi&ie=UTF8&qid=1501352154&sr=1-1&keywords=prohold+magnetic+holder, download Jul. 29, 2017.

* cited by examiner

LASER RANGEFINDER HOLDER

CROSS REFERENCE TO RELATED APPLICATION

This application claims priority to U.S. Patent Application Ser. No. 62/238,899, filed Oct. 8, 2015, by Gamblin et al, and entitled "Laser Rangefinder Holder", which is incorporated herein by reference in its entirety.

BACKGROUND OF THE INVENTION

Technical Field

This invention relates to sporting accessories, and specifically for a holder for a laser rangefinder.

State of the Art

Laser rangefinders are in common use when playing golf in order to determine the distance a golf ball should travel, or to determine the distance to a golf ball or other landmark. Laser rangefinders are also used for other sports and hobbies such as hunting, boating, and camping. For example, laser rangefinders are used to determine the distance to a target when hunting, or the distance to a buoy or other marker when boating. It can be cumbersome to carry the laser rangefinder with a hand or in a pants pocket. If the laser rangefinder is carried in the golf bag or other bag, one is always searching the bag for the laser rangefinder.

Accordingly, what is needed is a holder for a laser rangefinder that couples the laser rangefinder to a convenient hard surface, such as a golf cart or hunting blind.

DETAILED DESCRIPTION OF EMBODIMENTS OF THE INVENTION

As discussed above, embodiments of the present invention relate to sporting accessories, and specifically to a holder for a laser rangefinder.

Laser rangefinders are in common use in a number of different sporting and outdoor activities. For example, laser rangefinders are used on golf courses to determine the distance a golf ball should travel, or to determine the distance to a golf ball or other landmark. It can be cumbersome to carry the laser rangefinder with the hands or in a pocket. If the laser rangefinder is carried in the golf bag, one is always searching the golf bag for the laser rangefinder. In another example, laser rangefinders are used to determine the distance to a target during hunting or shooting activities. Laser rangefinders are used in a number of sporting activities to determine the distance to a landmark or target. Often it is desired to have the laser rangefinder close by, but it is not desired to have to carry it with the hands or in a pocket. Accordingly, what is needed is a holder for a laser rangefinder that couples the laser rangefinder to a golf cart, hunting stand, shooting blind, or other solid surface. Disclosed herein is a laser rangefinder holder that securely holds the laser rangefinder, and is easily coupled to a metal surface on a golf cart, such as a golf cart roof support, for example, or another metal surface. The laser rangefinder holder allows the laser rangefinder to be easily accessed, used, and replaced during golf or other sporting activities.

The laser rangefinder holder includes a rangefinder wrap, at least one magnet coupled to the rangefinder wrap, and a buckle ring coupled to the rangefinder wrap. The rangefinder wrap is made of a strip of flexible material with a buckle end and a foldover end opposing the buckle end. The buckle end is coupled to the buckle ring. The rangefinder wrap uses the buckle ring to wrap and couple the rangefinder wrap around the laser rangefinder. The magnets couple the laser rangefinder holder to a metal surface so the laser rangefinder holder and the laser rangefinder it is holding are easily accessed and removed from the metal surface so the laser rangefinder can be used.

The rangefinder wrap includes an encircling portion and a foldover portion. The encircling portion of the rangefinder wrap is wrapped around the laser rangefinder. The foldover portion of the rangefinder wrap extends through the buckle ring once the encircling portion is wrapped around the laser rangefinder, and is folded back over itself to tighten the rangefinder wrap around the laser rangefinder. The foldover portion removeably couples to the encircling portion to securely fasten the laser rangefinder holder around the laser rangefinder.

Figure 1:
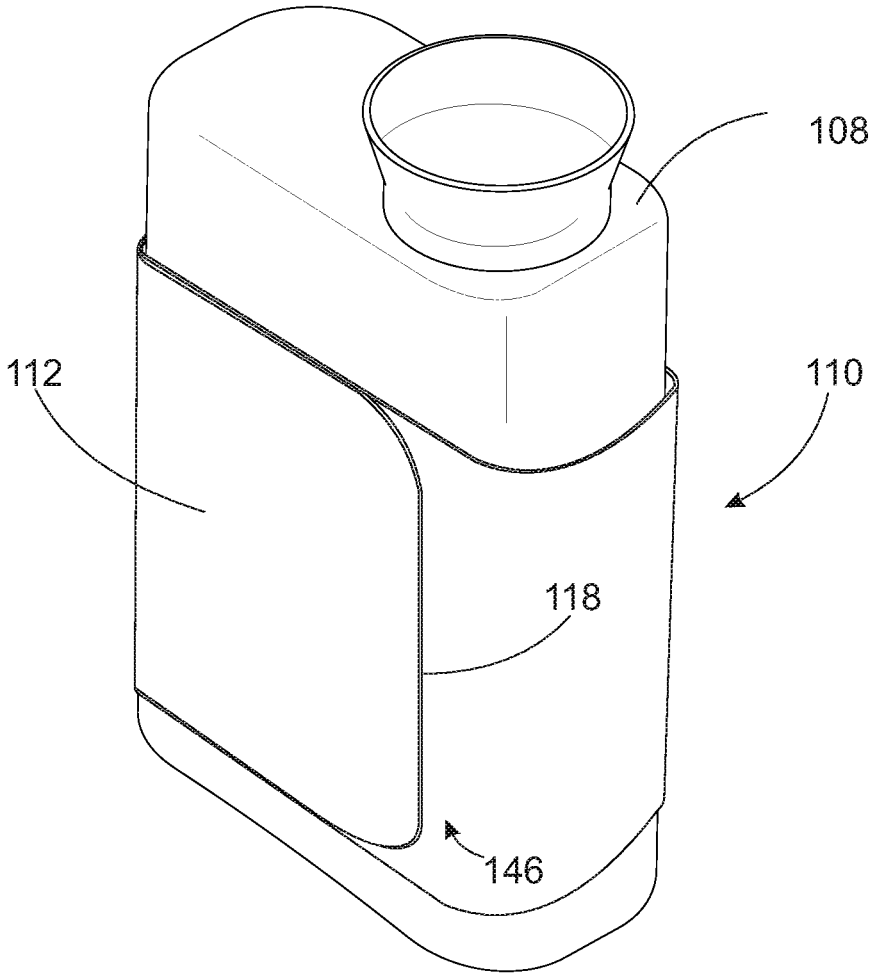
FIG. 1 shows a front perspective view of an embodiment of a laser rangefinder holder holding a laser rangefinder.
Figure 2:
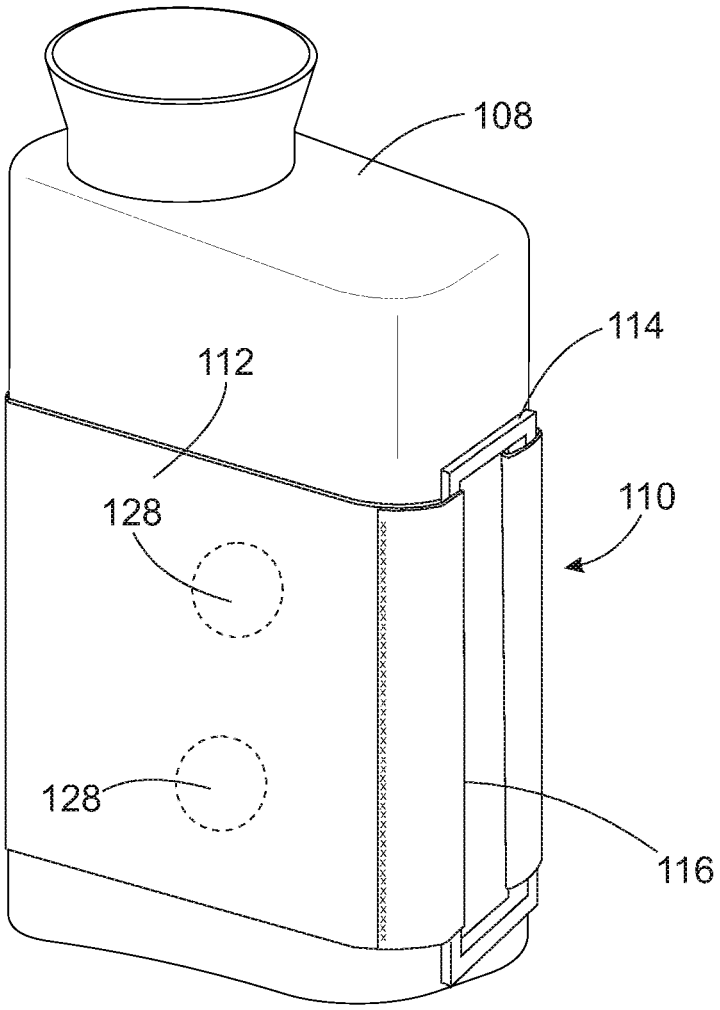
FIG. 2 shows a rear perspective view of the laser rangefinder holder of FIG. 1 holding the laser rangefinder.
Figure 3:
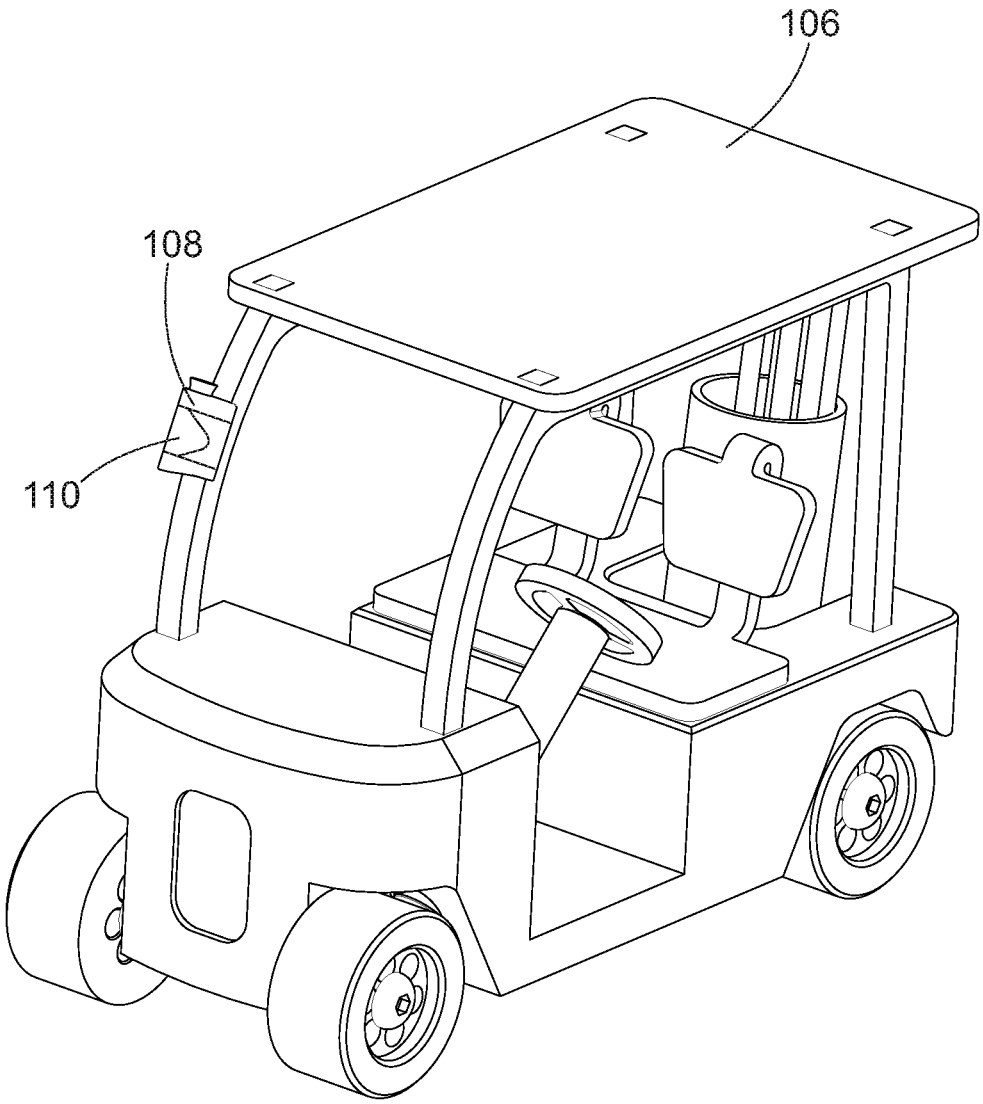
FIG. 3 shows the laser rangefinder holder of FIG. 1 coupling the laser rangefinder to a golf cart.
Figure 4:
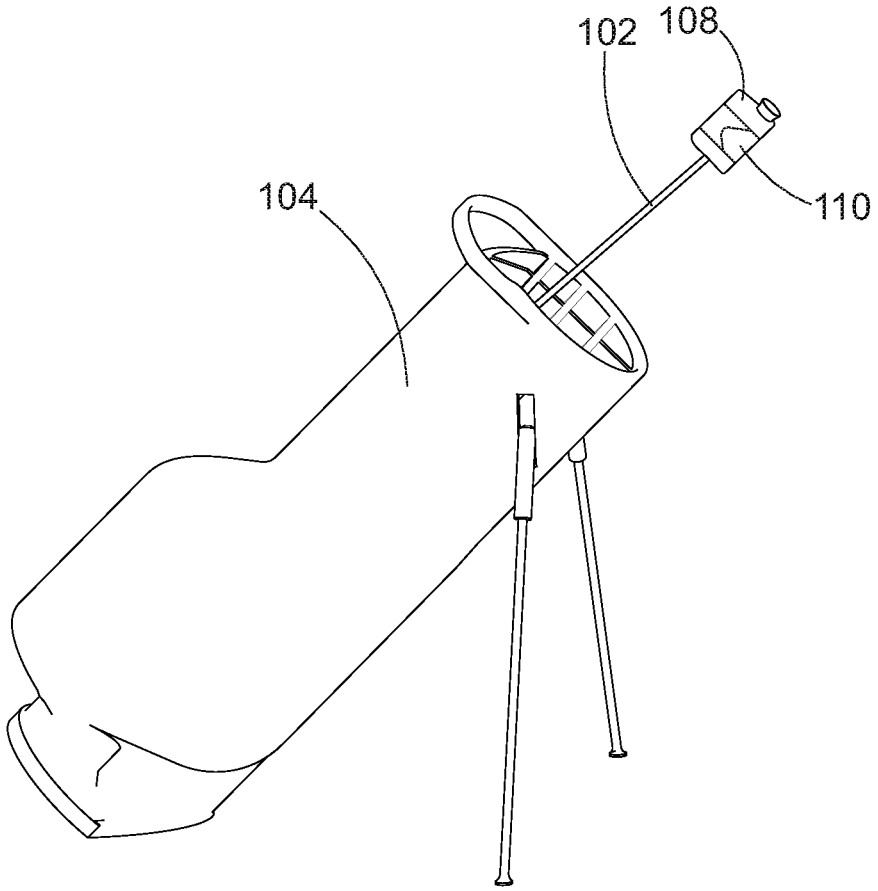
FIG. 4 shows the laser rangefinder holder of FIG. 1 coupling the laser rangefinder to a golf club.
Figure 5:
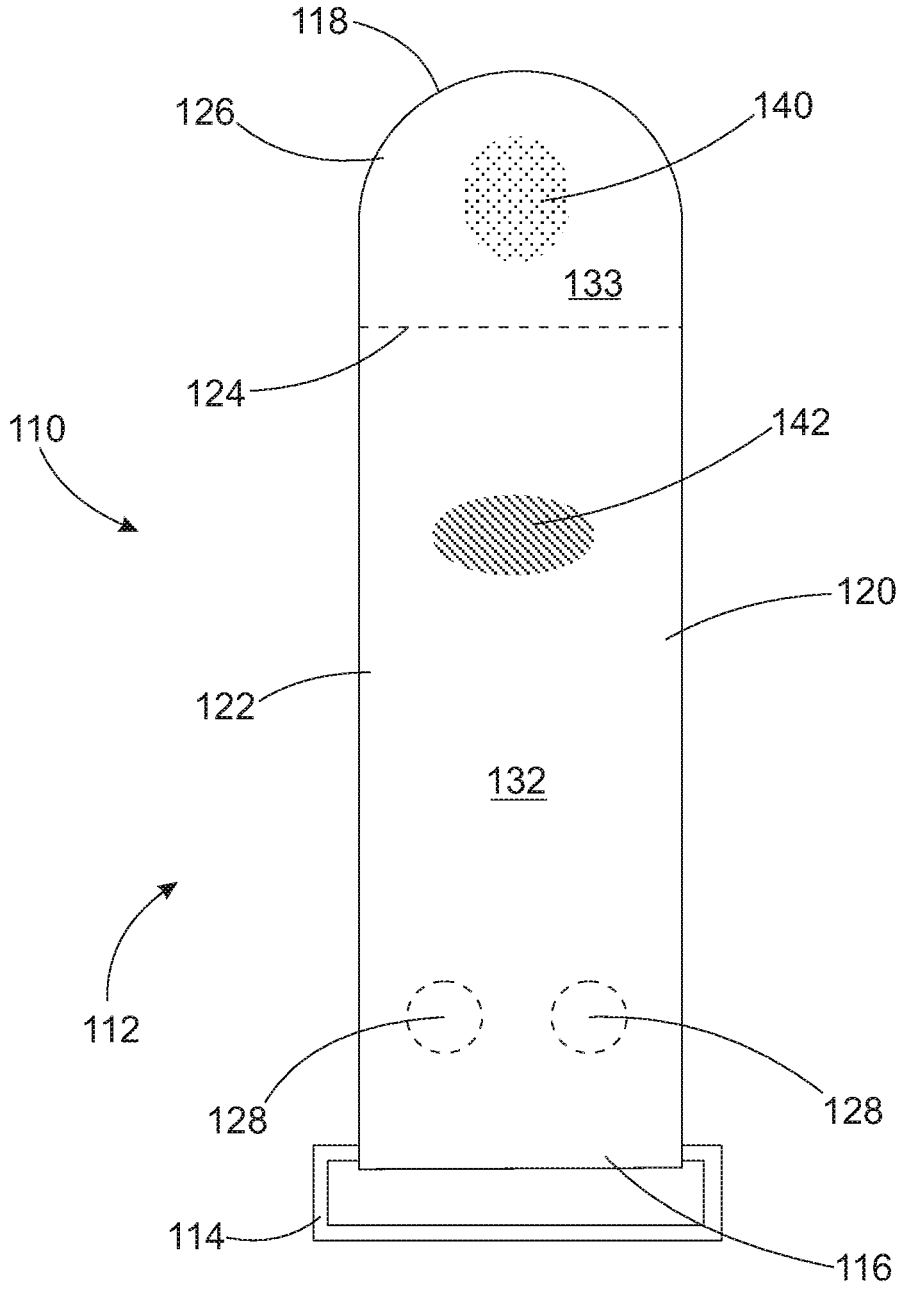
FIG. 5 shows a front view of the laser rangefinder holder of FIG. 1.

FIG. 1 through FIG. 5 show an embodiment of a laser rangefinder holder 110 and a laser rangefinder 108. FIG. 1 shows a front perspective view of laser rangefinder holder 110 holding laser rangefinder 108. FIG. 2 shows a rear perspective view of laser rangefinder holder 110 holding laser rangefinder 108. FIG. 3 shows laser rangefinder holder 110 removeably coupling laser rangefinder 108 to a golf cart 106. FIG. 4 shows laser rangefinder holder 110 removeably coupling laser rangefinder 108 to a golf club 102 that is in golf bag 104. FIG. 5 shows a front view of laser rangefinder holder 110.

Laser rangefinder holder 110 is used to removeably couple a laser rangefinder, such as laser rangefinder 108 shown in FIG. 1 through FIG. 4, to golf cart 106, golf club 102, or other metal surface, so that laser rangefinder 108 is in easy access during sporting activities. Laser rangefinder holder 110 includes at least one magnet 128 to removeably couple laser rangefinder holder 110 holding laser rangefinder 108 to a metal surface such as golf cart 106 or golf club 102.

Laser rangefinder 108 is only one type of laser rangefinder that can be held by laser rangefinder holder 110. Laser rangefinder holder 110 can hold many types and varieties of laser rangefinders, and can also be used to hold other sports or golf accessories. Laser rangefinder holder 110 can be used to hold many different types of sporting equipment, and to couple the sporting equipment to a metal surface.

Laser rangefinder holder 110 as shown in FIG. 1 through FIG. 5 includes a rangefinder wrap 112, a buckle ring 114, and at least one magnet 128. Rangefinder wrap 112 wraps around laser rangefinder 108 and is coupled to, and securely tightened onto, laser rangefinder 108 using a coupling device such as a hook and loop coupler 146 in this embodiment. Rangefinder wrap 112 wraps around laser rangefinder 108, with buckle 114 held against laser rangefinder 108 as shown in FIG. 2. A foldover end 118 of rangefinder wrap 112 slips through buckle 114 and is then folded back over itself as shown in FIG. 1 and FIG. 2. Foldover end 118 couples to rangefinder wrap 112, using hook and loop attachment 146 in this embodiment, to tighten laser rangefinder holder 110 around laser rangefinder 108 and securely hold laser rangefinder 108. Magnets 128 coupled to rangefinder wrap 112 (FIG. 2 and FIG. 5) are used to couple laser rangefinder holder 110 and laser rangefinder 108 to a metal surface such as a roof support of a golf cart 106 as shown in FIG. 3, or a golf club head of a golf club 102, as shown in FIG. 4. Magnets 128 can be used to couple laser rangefinder holder 110 and laser rangefinder 108 to any metal surface such as a hunting blind, a metal pole, a metal wall or table, etc. In some embodiments, laser rangefinder 110 includes coupling devices other than magnets so that laser rangefinder holder 110 and laser rangefinder 108 can be coupled to a surface that is not metal. Hooks, rings, loops, snaps, or other coupling devices can be used instead of, or in addition to, magnets 128, for example.

FIG. 5 shows a front view of laser rangefinder holder 110 unwrapped from laser rangefinder 108. Laser rangefinder holder 110 includes rangefinder wrap 112 and buckle ring 114. Buckle ring 114 is removeably coupled to a buckle end 116 of rangefinder wrap 112. In this embodiment, rangefinder wrap 112 is formed of a strip of flexible material 120 such as, for example but not by way of limitation, neoprene or nylon. Rangefinder wrap 112 can be formed of any flexible material that can wrap around a laser rangefinder or other device. Buckle ring 114 is a rectangular plastic ring with rounded corners in this example, but this is not meant to be limiting. Buckle ring 114 can be formed of any hard material and can be many different shapes.

Buckle ring 114 is sewn to rangefinder wrap 112 in this embodiment, but this is not meant to be limiting. In some embodiments, buckle ring 114 is removeably attached to rangefinder wrap 112 using a hook and loop attachment device or other coupling mechanism. Buckle ring 114 can be removeably or non-removeably attached to rangefinder wrap 112 using any type of attachment or coupling device. Rangefinder wrap 112 includes foldover end 118 opposing buckle end 116 of rangefinder wrap 112. In the embodiment shown in the figures, foldover end 118 is rounded, but this is not meant to be limiting.

Rangefinder wrap 112 includes an encircling portion 122. Encircling portion 122 extends from buckle end 116 to a folding line 124, as shown in FIG. 5. Folding line 124 is between buckle end 116 and foldover end 118, and is where rangefinder wrap 112 is often folded over onto itself to encase laser rangefinder 108. Encircling portion 122 encircles and holds laser rangefinder 108. Rangefinder wrap 112 also includes a foldover portion 126. Foldover portion 126 extends from folding line 124 to foldover end 118. Front surface 132 of encircling portion 122 is covered with a first part of hook and loop attachment 146, such as loop portion 142 in this embodiment. Front surface 133 of foldover portion 126 is covered with a mating part of hook and loop attachment 146, such as hook portion 140 in this embodiment. Encircling portion 122 is wrapped about laser rangefinder 108, and is tightened to hold laser rangefinder 108. Foldover portion 126 is slipped through buckle ring 114, folded back over itself, and coupled to encircling portion 122 using hook and loop attachment 140 and 142. It is to be understood that many other attachment methods can be used besides hook and loop portions 140 and 142, such as snaps or ties, for example.

Rangefinder wrap 112 also includes at least one magnet 128 coupled to rangefinder wrap 112. In the embodiment shown in FIG. 1 through FIG. 5, rangefinder wrap 112 includes two magnets 128. Magnets 128 removeably couple laser rangefinder holder 110 to any metal surface, such as the surface of a golf cart (FIG. 3) or a hunting blind support, for example. Laser rangefinder holder 110 that is coupled to a golf cart using magnets 128 can be easily removed from the golf cart, and laser rangefinder 108 accessed and used. Laser rangefinder 108 is easily located, used, and put back on the golf cart when laser rangefinder holder 110 is used.

Each magnet 128 is coupled to the inside surface of rangefinder wrap 112 in this embodiment. In this embodiment, magnets 128 are glued to the inside surface of rangefinder wrap 112, but this is not meant to be limiting. In some embodiments, magnets 128 are embedded in strip of flexible material 120. In some embodiments, magnets 128 are coupled to rangefinder wrap 112 using a magnet holder strip that is sewed or glued, for example, to rangefinder wrap 112 (see laser rangefinder holder 210 shown in FIG. 6 through FIG. 8). In the embodiment shown in FIG. 1 through FIG. 5, each magnet 128 is coupled to rangefinder wrap 112 near buckle ring 114, but this is not meant to be limiting.

Figure 6:
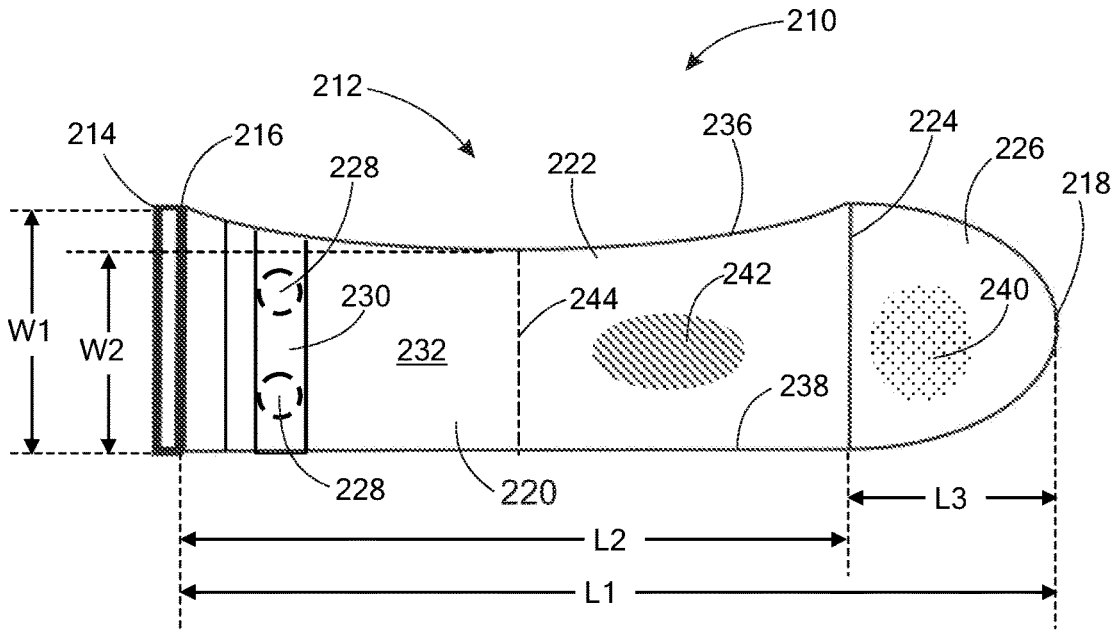
FIG. 6 shows a front view of an additional embodiment of a laser rangefinder holder.
Figure 7:
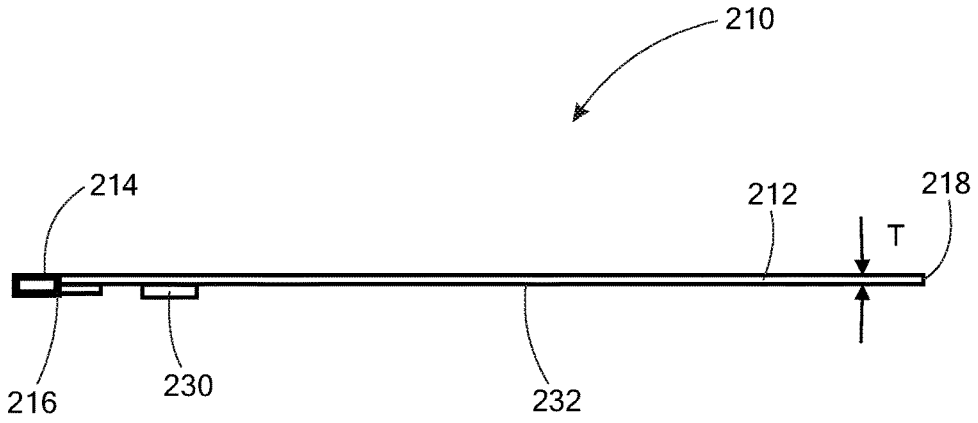
FIG. 7 shows a top view of the laser rangefinder holder of FIG. 6.
Figure 8:
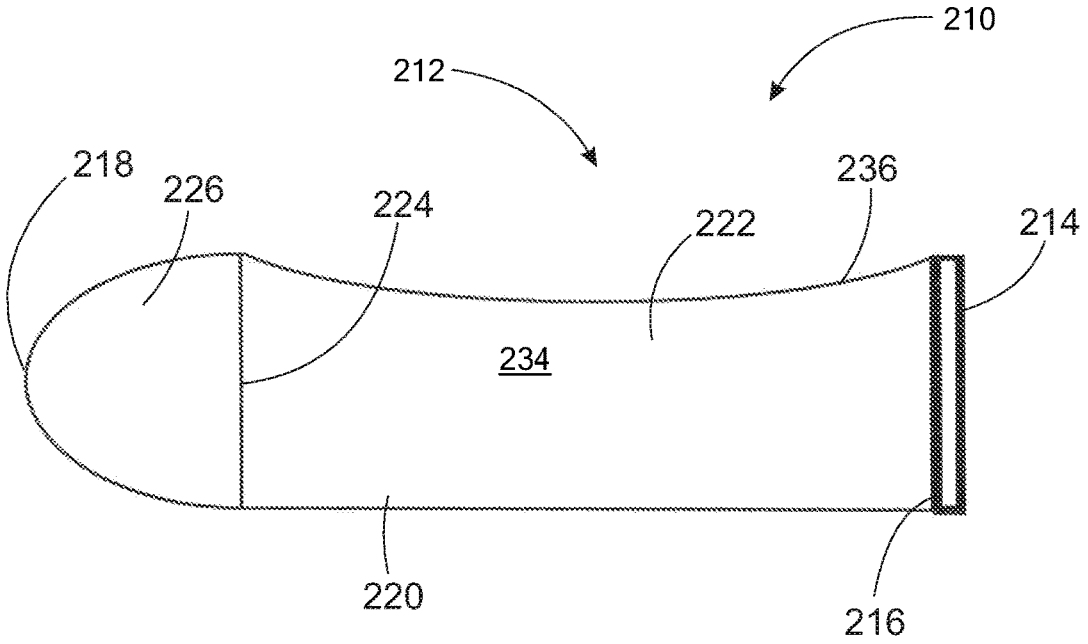
FIG. 8 shows a rear view of the laser rangefinder holder of FIG. 6

FIG. 6 through FIG. 8 shows an embodiment of a laser rangefinder holder 210. Laser rangefinder holder 210 can be used in place of laser rangefinder holder 110 as shown in FIG. 1 through FIG. 4. FIG. 6 shows a front view of laser rangefinder holder 210. FIG. 7 shows a top edge view of laser rangefinder holder 210. FIG. 8 shows a rear view of laser rangefinder holder 210 including a rear surface 234 of rangefinder wrap 210. Laser rangefinder holder 210 as shown in FIG. 6 through FIG. 8 includes a rangefinder wrap 212 and a buckle ring 214, and two magnets 228. Rangefinder wrap 212 wraps around laser rangefinder 108, for example, and is coupled to, and securely tightened onto, laser rangefinder 108 using a hook and loop attachment as explained for laser rangefinder 110. Laser rangefinder holder 210 couples a laser rangefinder or other device to a metal surface using magnets 228, as explained for laser rangefinder holder 110.

Buckle ring 214 is coupled to a buckle end 216 of rangefinder wrap 212. In this embodiment, rangefinder wrap 212 is formed of a strip of flexible material 220 such as, for example but not by way of limitation, neoprene or nylon. Rangefinder wrap 212 can be formed of any flexible material. Buckle ring 214 is a rectangular plastic ring in this example, but this is not meant to be limiting. Buckle ring 214 can be formed of any hard material and can be many different shapes. Buckle ring 214 can be removeably or non-removeably attached to rangefinder wrap 212 using any type of attachment or coupling device.

Rangefinder wrap 212 includes a foldover end 218 opposing buckle end 216 of rangefinder wrap 212. In the embodiment shown in the figures, foldover end 218 is rounded, but this is not meant to be limiting. Strip of flexible material 220 extends between buckle end 216 and foldover end 218.

Rangefinder wrap 112 includes an encircling portion 222. Encircling portion 222 extends from buckle end 216 to a folding line 224 (FIG. 6 and FIG. 8). Folding line 224 is between buckle end 216 and foldover end 218, and is where rangefinder wrap 212 is often folded over onto itself to encase a laser rangefinder, such as laser rangefinder 108, or other device. Encircling portion 222 encircles and holds laser rangefinder 108 or other device.

Rangefinder wrap 212 includes a foldover portion 226. Foldover portion 226 extends from folding line 224 to foldover end 218. Front surface 232 of encircling portion 222 is covered with a first part of a hook and loop attachment, such as loop portion 242 in this embodiment (FIG. 6). Front surface 233 of foldover portion 226 is covered with a mating part of the hook and loop attachment, such as hook portion 240 in this embodiment (FIG. 6). Encircling portion 222 is wrapped about laser rangefinder 108 or another device, and is tightened to hold laser rangefinder 108. Foldover portion 226 is slipped through buckle ring 214, folded back over encircling portion 222, and coupled to encircling portion 222 using hook and loop attachment 240 and 242. It is to be understood that any other attachment methods can be used besides hook and loop portions 240 and 242.

Rangefinder wrap 212 also includes two magnets 228 coupled to rangefinder wrap 212. Magnets 228 removeably couple laser rangefinder holder 210 to any metal surface, such as the surface of a golf cart or a hunting blind support, for example. Laser rangefinder holder 210 that is coupled to a golf cart using magnets 228 can be easily removed from the metal surface, and laser rangefinder 108 accessed and used. Laser rangefinder 108 is easily located, used, and put back on the golf cart when laser rangefinder holder 210 is used. Magnets 228 are coupled to rangefinder wrap 212 by a magnet holder strip 230 coupled to rangefinder wrap 212, see FIG. 6 and FIG. 7. In this embodiment, magnet holder strip 230 is glued to rangefinder wrap 212, with magnets 228 positioned between rangefinder wrap 212 and magnet holder strip 230. In this embodiment, magnet holder strip 230 is made of leather, but this is not meant to be limiting. Magnet holder strip 230 and magnets 228 can be coupled to rangefinder wrap 212 in many different locations. In the embodiment shown, magnet holder strip 230 holds magnets 228 near buckle ring 214. In this embodiment, magnets 228 are about 57 millimeters (mm) from buckle ring 214. This distance between buckle ring 214 and magnets 228 has been shown to place magnets 228 along a side of laser rangefinder 108 so that magnets 228 can easily grab and hold a magnetic surface. In some embodiments, the distance between buckle ring 214 and magnets 228 is between about 50 mm and about 75 mm. This range of distances has been shown to put magnets 228 along a side of laser rangefinder 108 and keep magnets 228 away from the edges and corners of laser rangefinder 108. It is to be understood, however, that other distances may be used for other sizes of laser rangefinder holder 210, other devices to be held with laser rangefinder holder 210, and other mounting configurations.

Rangefinder wrap 212 has a length L1, a width W1, and a thickness T, as shown in FIG. 6 and FIG. 7. Rangefinder wrap length L1 is greater than rangefinder wrap width W1. Rangefinder wrap thickness T is often between about 0.5 to about 5 millimeters (mm). In this embodiment, rangefinder wrap thickness T is about 1 mm. Encircling portion 222 has an encircling portion length L2, and foldover portion 226 has a foldover portion length L3. Foldover portion length L3 is less than encircling portion length L2 in this embodiment. In the embodiment shown, rangefinder wrap length L1 is about 280 mm. In some embodiments, rangefinder wrap length L1 is between about 250 and about 400 mm. In the embodiment shown, encircling portion length L2 is about 180 mm. In some embodiments, encircling portion length L2 is between about 150 mm and about 280 mm. In the embodiment shown, foldover portion length L3 is about 100 mm. In some embodiments, foldover portion length L3 is between about 100 mm and about 220 mm.

Rangefinder wrap width W1 in the embodiment shown in the figures is about 70 mm, but this is not meant to be limiting. In some embodiments, rangefinder wrap width W1 is about 63.5 mm. Rangefinder wrap widths W1 of between 60 and 70 mm have been shown to securely hold laser rangefinder 108 without blocking buttons or covering too much of laser rangefinder 108. In other embodiments, rangefinder wrap width W1 can be between about 30 mm and about 130 mm to handle smaller or larger devices.

Rangefinder wrap 212 can be many different shapes. In the embodiment shown in FIG. 6 through FIG. 8, encircling portion 222 has a top edge 236 that is concave, with a minimum width W2 at a minimum width line 244, as shown in FIG. 6. In this embodiment, minimum width line 244 is halfway between buckle end 216 and folding line 224, but this is not meant to be limiting. In this embodiment, encircling portion 222 has a bottom edge 238 that is straight and perpendicular to buckle end 216. Encircling portion 222, in this embodiment, has a maximum width of about 70 mm at buckle end 216 and folding line 224. Encircling portion 222 has a minimum width W2 of approximately 62.6 mm in this embodiment. In some embodiments, minimum width W2 is between 33 and 73 mm. It is to be understood that encircling portion 222 can have many different shapes, sizes, and dimensions according to the specific size and shape of the laser rangefinder to be held and the specific design of laser rangefinder holder 210.

Figure 9:
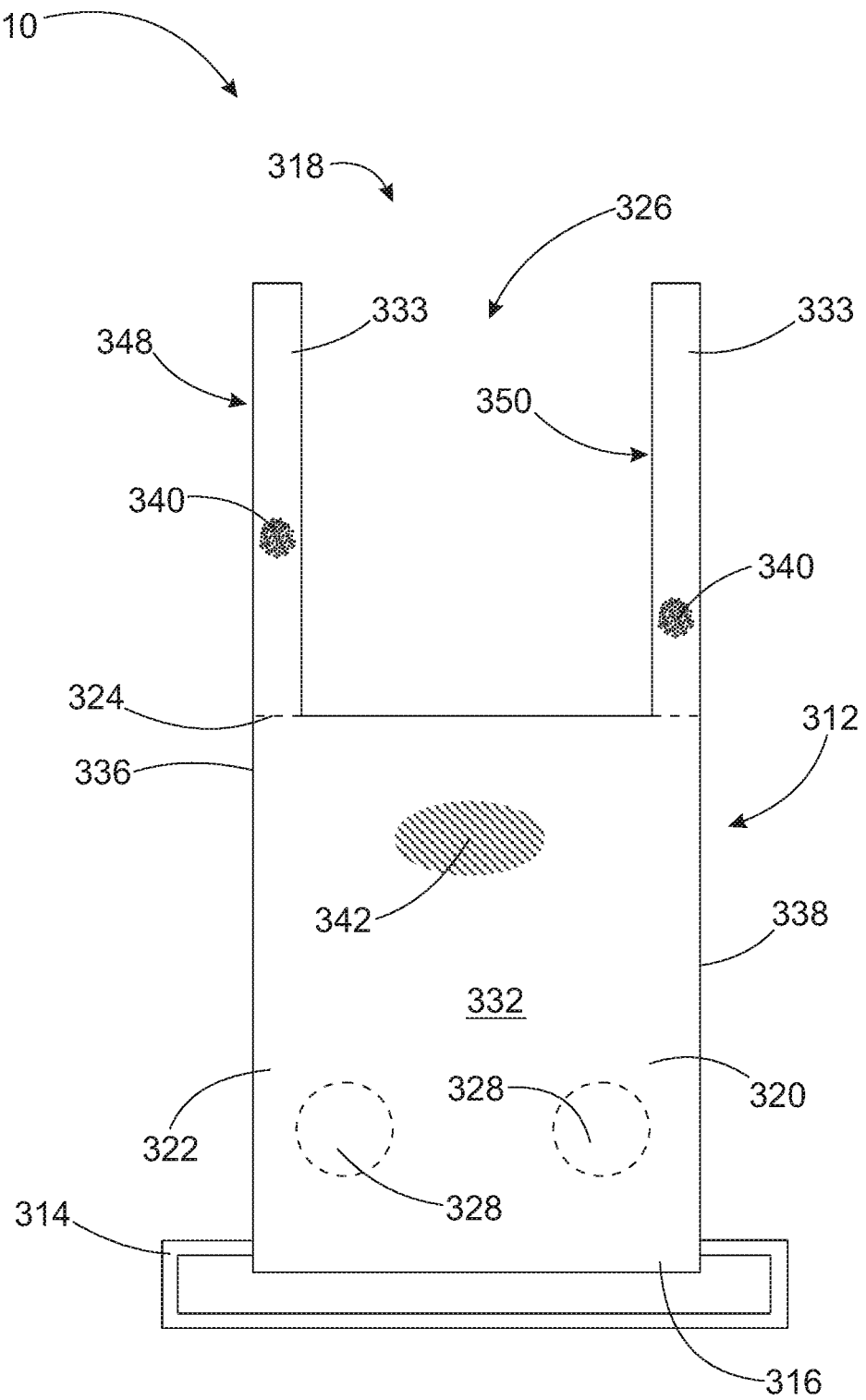
FIG. 9 shows a front view of a further embodiment of a laser rangefinder holder.

FIG. 9 shows an embodiment of a laser rangefinder holder 310. Laser rangefinder holder 310 is similar to laser rangefinder holders 110 and 210 explained above, but in this embodiment, the foldover portion 326 of laser rangefinder 310 has two foldover arms 348 and 350, which can be used to wrap around a laser rangefinder or other device independently. FIG. 9 shows a front perspective view of laser rangefinder holder 310. Laser rangefinder 310 can be used in place of laser rangefinder 110 as shown in FIG. 1 through FIG. 4. Laser rangefinder holder 310 is used to removeably couple a laser rangefinder, such as laser rangefinder 108 shown in FIG. 1 through FIG. 4, to golf cart 106, golf club 102, or other metal surface, so that laser rangefinder 108 is in easy access during sporting activities. Laser rangefinder holder 310 includes at least one magnet 328, to removeably couple laser rangefinder holder 310, holding laser rangefinder 108, to a metal surface such as golf cart 106 or golf club 102.

Laser rangefinder 108 is only one type of laser rangefinder that can be held by laser rangefinder holder 310. Laser rangefinder holder 310 can hold many types and varieties of laser rangefinders, and can also be used to hold other sports or golf accessories. Laser rangefinder holder 310 can be used to hold many different types of sporting equipment, and to couple the sporting equipment to a metal surface.

Laser rangefinder holder 310 as shown in FIG. 9 includes a rangefinder wrap 312, a buckle ring 314, and at least one magnet 328. Rangefinder wrap 312 wraps around a laser rangefinder, such as laser rangefinder 108, and is coupled to, and securely tightened onto, the laser rangefinder using a coupling device such as a hook and loop coupler. Rangefinder wrap 312 wraps around the laser rangefinder, with buckle 314 held against the laser rangefinder.

Foldover end 318 of rangefinder wrap 312, in this embodiment, includes first foldover arm 348 and second foldover arm 350. First foldover arm 348 and second foldover arm 350 of rangefinder wrap 312 slip through buckle 314 and are folded back over an encircling portion 322 to couple rangefinder wrap 312 to the laser rangefinder. Magnets 328 coupled to rangefinder wrap 312 are used to couple laser rangefinder holder 310 and the laser rangefinder to a metal surface such as a roof support of a golf cart 106 as shown in FIG. 3, or a golf club head of a golf club 102, as shown in FIG. 4. Magnets 328 can be used to couple laser rangefinder holder 310 and the laser rangefinder to any metal surface such as a hunting blind, a metal pole, a metal wall or table, etc. In some embodiments, laser rangefinder 310 includes coupling devices other than magnets so that laser rangefinder holder 310 and a laser rangefinder can be coupled to a surface that is not metal. Hooks, rings, loops, snaps, or other coupling devices can be used instead of, or in addition to, magnets 328, for example.

FIG. 9 shows a front view of laser rangefinder holder 310. Laser rangefinder holder 310 includes rangefinder wrap 312 and buckle ring 314. Buckle ring 314 is removeably coupled to a buckle end 316 of rangefinder wrap 312. In this embodiment, rangefinder wrap 312 is formed of a strip of flexible material 320 such as, for example but not by way of limitation, neoprene or nylon. Rangefinder wrap 312 can be formed of any flexible material that can wrap around a laser rangefinder or other device. Buckle ring 314 is an oval-shaped plastic ring in this example, but this is not meant to be limiting. Buckle ring 314 can be formed of any hard material and can be many different shapes.

Buckle ring 314 is sewn to rangefinder wrap 312 in this embodiment, but this is not meant to be limiting. In some embodiments, buckle ring 314 is removeably attached to rangefinder wrap 312 using a hook and loop attachment device or other coupling mechanism. Buckle ring 314 can be removeably or non-removeably attached to rangefinder wrap 312 using any type of attachment or coupling device.

Rangefinder wrap 312 includes foldover end 318 opposing buckle end 316 of rangefinder wrap 312. In the embodiment shown in the figures, foldover end 318 is rectangular shaped, but this is not meant to be limiting. In this embodiment, foldover end 318 includes the ends of first foldover arm 348 and second foldover arm 350.

Rangefinder wrap 312 includes an encircling portion 322. Encircling portion 322 extends from buckle end 316 to a folding line 324, as shown in FIG. 9. Folding line 324 is between buckle end 316 and foldover end 318, and is where rangefinder wrap 312 is often folded over onto itself to encase a laser rangefinder. Encircling portion 322 encircles and holds the laser rangefinder.

Rangefinder wrap 312 also includes a foldover portion 326. Foldover portion 326 extends from folding line 324 to foldover end 318. In this embodiment, foldover portion 326 include two foldover arms, first foldover arm 348 and second foldover arm 350. Each of first foldover arm 348 and second foldover arm 350 are rectangular strips of flexible material that extend from encircling portion 322 in a direction parallel to a top edge 336 of encircling portion 322. First and second foldover arms 348 and 350 act similar to foldover portions 126 and 226 explained earlier, except that first and second foldover arms 348 and 350 are separate strips of flexible material that can wrap around a laser rangefinder or other device independently of each other, and so provide for greater flexibility in wrapping and encircling the device in different directions.

Front surface 332 of encircling portion 322 is covered with a first part of a hook and loop attachment device, such as loop portion 342 in this embodiment. Front surfaces 333 of first and second foldover arms 348 and 350 are covered with a mating part of the hook and loop attachment, such as hook portion 340 in this embodiment. Encircling portion 322 is wrapped about a laser rangefinder or other device, and is tightened to hold the laser rangefinder. Foldover arms 348 and 350 are slipped through buckle ring 314, folded back over themselves and coupled to encircling portion 322 using hook and loop attachment 340 and 342. Foldover arms 348 and 350 can wrap around the laser rangefinder or other device separately and in different directions if desired. It is to be understood that many other attachment methods can be used besides hook and loop portions 340 and 342, such as snaps or ties, for example.

Rangefinder wrap 312 also includes at least one magnet 328 coupled to rangefinder wrap 312. In the embodiment shown in FIG. 9, rangefinder wrap 312 includes two magnets 328. Magnets 328 removeably couple laser rangefinder holder 310 to any metal surface, such as the surface of a golf cart (FIG. 3) or a hunting blind support, for example. Laser rangefinder holder 310 that is coupled to a golf cart using magnets 328 can be easily removed from the golf cart, and the laser rangefinder, such as laser rangefinder 108, accessed and used. Laser rangefinder 108 is easily located, used, and put back on the golf cart when laser rangefinder holder 310 is used to hold laser rangefinder 108.

Each magnet 328 is coupled to the inside surface of rangefinder wrap 312 in this embodiment. In this embodiment, magnets 328 are glued to the inside surface of rangefinder wrap 312, but this is not meant to be limiting. In some embodiments, magnets 328 are embedded in strip of flexible material 320. In some embodiments, magnets 328 are coupled to rangefinder wrap 312 using a magnet holder strip that is sewed or glued, for example, to rangefinder wrap 312 (see laser rangefinder holder 210 shown in FIG. 6-FIG. 8). In the embodiment shown in FIG. 9, each magnet 328 is coupled to rangefinder wrap 312 near buckle ring 314, but this is not meant to be limiting. In the embodiment shown in FIG. 9, each magnet 328 is coupled to rangefinder wrap 312 a distance of 50 mm from buckle ring 314. In some embodiments, each magnet 328 is coupled to rangefinder wrap 312 a distance of between 40 mm and 60 mm from buckle ring 314.

Figure 10:
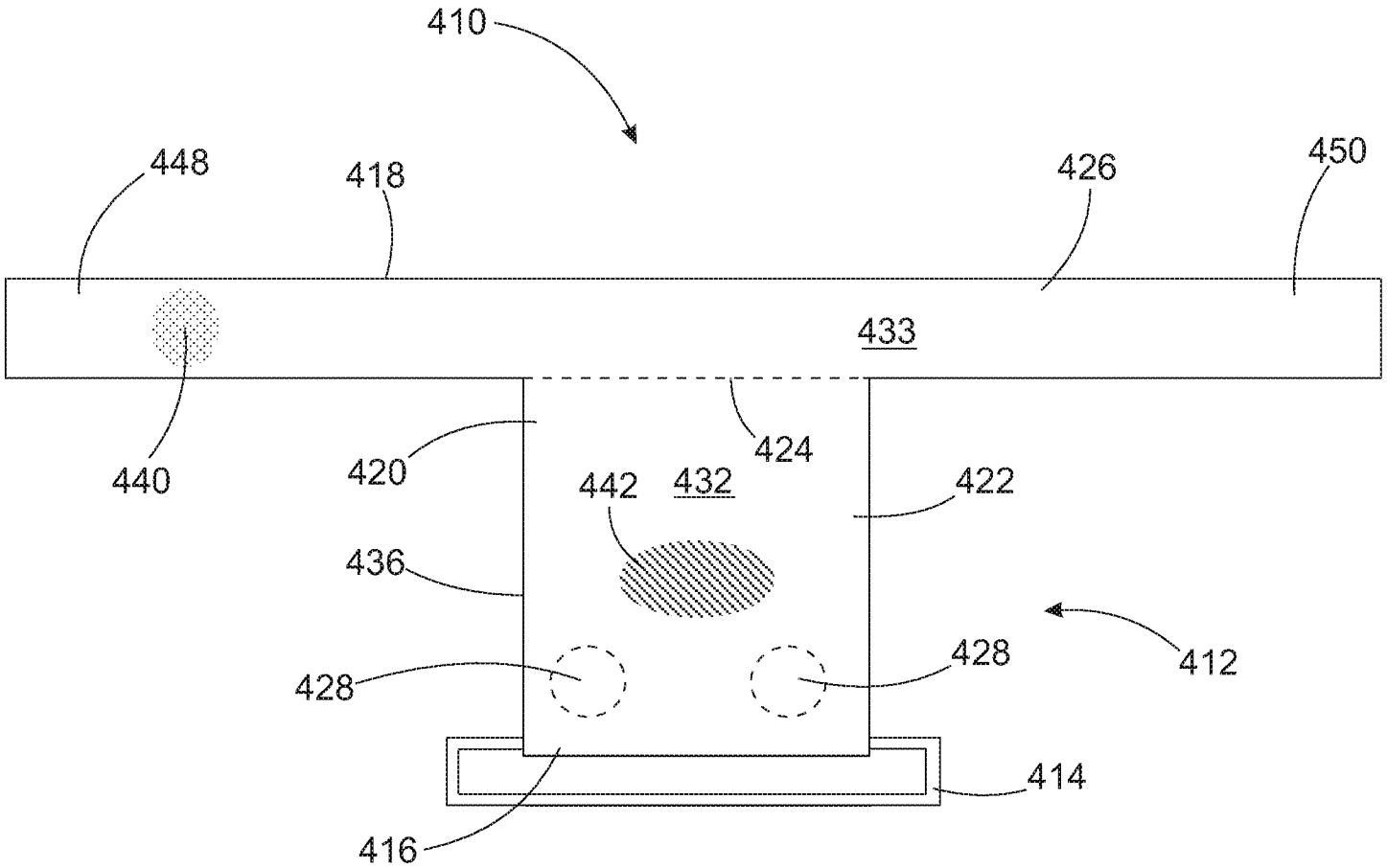
FIG. 10 shows a front view of a further embodiment of a laser rangefinder holder.

FIG. 10 shows an embodiment of a laser rangefinder holder 410. Laser rangefinder holder 410 is similar to laser rangefinder holders 110, 210, and 310 explained above, but in this embodiment the foldover portion 426 of laser rangefinder 410 has two foldover arms 448 and 450 that extend perpendicular to a top edge 436 of an encircling portion 422. Foldover arms 448 and 450 can be used to wrap around a laser rangefinder or other device in differing configurations. FIG. 10 shows a front perspective view of laser rangefinder holder 410. Laser rangefinder 410 can be used in place of laser rangefinder 110 as shown in FIG. 1 through FIG. 4, for example. Laser rangefinder holder 410 is used to removeably couple a laser rangefinder, such as laser rangefinder 108 shown in FIG. 1 through FIG. 4, to golf cart 106, golf club 102, or other metal surface, so that laser rangefinder 108 is in easy access during sporting activities. Laser rangefinder holder 410 includes at least one magnet 428, to removeably couple laser rangefinder holder 410 holding laser rangefinder 108 to a metal surface such as golf cart 106 or golf club 102.

Laser rangefinder 108 is only one type of laser rangefinder that can be held by laser rangefinder holder 410. Laser rangefinder holder 410 can hold many types and varieties of laser rangefinders, and can also be used to hold other sports or golf accessories. Laser rangefinder holder 410 can be used to hold many different types of sporting equipment, and to couple the sporting equipment to a metal surface.

Laser rangefinder holder 410 as shown in FIG. 10 includes a rangefinder wrap 412, a buckle ring 414, and at least one magnet 428. Rangefinder wrap 412 wraps around a laser rangefinder, such as laser rangefinder 108, and is coupled to, and securely tightened onto, the laser rangefinder using a coupling device such as a hook and loop coupler. Rangefinder wrap 412 wraps around the laser rangefinder with buckle 414 held against the laser rangefinder. Foldover end 418 of rangefinder wrap 412 in this embodiment includes first foldover arm 448 and second foldover arm 450. First foldover arm 448 and second foldover arm 450 of rangefinder wrap 412 slip through buckle 414 and are folded back over themselves to couple rangefinder wrap 412 to the laser rangefinder. Magnets 428 coupled to rangefinder wrap 412 are used to couple laser rangefinder holder 410 and the laser rangefinder to a metal surface such as a roof support of a golf cart 106 as shown in FIG. 3, or a golf club head of a golf club 102, as shown in FIG. 4. Magnets 428 can be used to couple laser rangefinder holder 410 and the laser rangefinder to any metal surface such as a hunting blind, a metal pole, a metal wall or table, etc. In some embodiments, laser rangefinder 410 includes coupling devices other than magnets so that laser rangefinder holder 410 and a laser rangefinder can be coupled to a surface that is not metal. Hooks, rings, loops, snaps, or other coupling devices can be used instead of, or in addition to, magnets 428, for example.

FIG. 10 shows a front view of laser rangefinder holder 410. Laser rangefinder holder 410 includes rangefinder wrap 412 and buckle ring 414. Buckle ring 414 is removeably coupled to a buckle end 416 of rangefinder wrap 312. In this embodiment, rangefinder wrap 412 is formed of a strip of flexible material 420 such as, for example but not by way of limitation, neoprene or nylon. Rangefinder wrap 412 can be formed of any flexible material that can wrap around a laser rangefinder or other device. Buckle ring 414 is an oval-shaped plastic ring in this example, but this is not meant to be limiting. Buckle ring 414 can be formed of any hard material and can be many different shapes. Buckle ring 414 can be removeably or non-removeably attached to rangefinder wrap 412 using any type of attachment or coupling device.

Rangefinder wrap 412 includes foldover end 418 opposing buckle end 416 of rangefinder wrap 412. In the embodiment shown in the figures, foldover end 418 is a straight edge, but this is not meant to be limiting.

Rangefinder wrap 412 includes an encircling portion 422. Encircling portion 422 extends from buckle end 416 to a folding line 424, as shown in FIG. 10. Folding line 424 is between buckle end 416 and foldover end 418, and is where rangefinder wrap 412 is often folded over onto itself to encase a laser rangefinder. Encircling portion 422 encircles and holds the laser rangefinder.

Rangefinder wrap 412 also includes a foldover portion 426. Foldover portion 426 extends from folding line 424 to foldover end 418. In this embodiment, Foldover portion 426 include two foldover arms, first foldover arm 448 and second foldover arm 450. Each of first foldover arm 448 and second foldover arm 450 are rectangular strips of flexible material that extend from encircling portion 422 in a direction perpendicular to a top edge 436 of encircling portion 422. First and second foldover arms 448 and 450 act similar to foldover arms 348 and 350 explained earlier, except that first and second foldover arms 448 and 450 extend perpendicular to top edge 436 of encircling portion 422 instead of parallel to top edge 436. First and second foldover arms 448 and 450 are separate strips of flexible material that can wrap around a laser rangefinder or other device independently of each other, and so provide for greater flexibility in wrapping and encircling the device in different directions.

Front surface 432 of encircling portion 422 is covered with a first part of a hook and loop attachment device, which is loop portion 442 in this embodiment. Front surface 433 of first and second foldover arms 448 and 450 is covered with a mating part of the hook and loop attachment, which is hook portion 440 in this embodiment. Encircling portion 422 is wrapped about a laser rangefinder or other device, and is tightened to hold the laser rangefinder. Foldover arms 448 and 450 are slipped through buckle ring 414, folded back over themselves and coupled to encircling portion 422 using hook and loop attachment 440 and 442. Foldover arms 448 and 450 can wrap around the laser rangefinder or other device separately and in different directions if desired. It is to be understood that many other attachment methods can be used besides hook and loop portions 440 and 442, such as snaps or ties, for example.

Rangefinder wrap 412 also includes at least one magnet 428 coupled to rangefinder wrap 412. In the embodiment shown in FIG. 10, rangefinder wrap 412 includes two magnets 428. Magnets 428 removeably couple laser rangefinder holder 410 to any metal surface, such as the surface of a golf cart (FIG. 3) or a hunting blind support, for example. Laser rangefinder holder 410 that is coupled to a golf cart using magnets 428 can be easily removed from the golf cart, and the laser rangefinder, such as laser rangefinder 108, accessed and used. Laser rangefinder 108 is easily located, used, and put back on the golf cart when laser rangefinder holder 410 is used to hold laser rangefinder 108.

Each magnet 428 is coupled to the inside surface of rangefinder wrap 412 in this embodiment. In this embodiment, magnets 428 are glued to the inside surface of rangefinder wrap 412, but this is not meant to be limiting. In some embodiments, magnets 428 are embedded in strip of flexible material 420. In some embodiments, magnets 428 are coupled to rangefinder wrap 412 using a magnet holder strip that is sewed or glued, for example, to rangefinder wrap 412 (see laser rangefinder holder 210 shown in FIG. 6-FIG. 8). In the embodiment shown in FIG. 10, each magnet 428 is coupled to rangefinder wrap 412 near buckle ring 414, but this is not meant to be limiting. In the embodiment shown in FIG. 10, each magnet 428 is coupled to rangefinder wrap 412 a distance of about 50 mm from buckle ring 414. In some embodiments, each magnet 428 is coupled to rangefinder wrap 412 a distance of between 40 mm and 60 mm from buckle ring 414.

Figure 11:
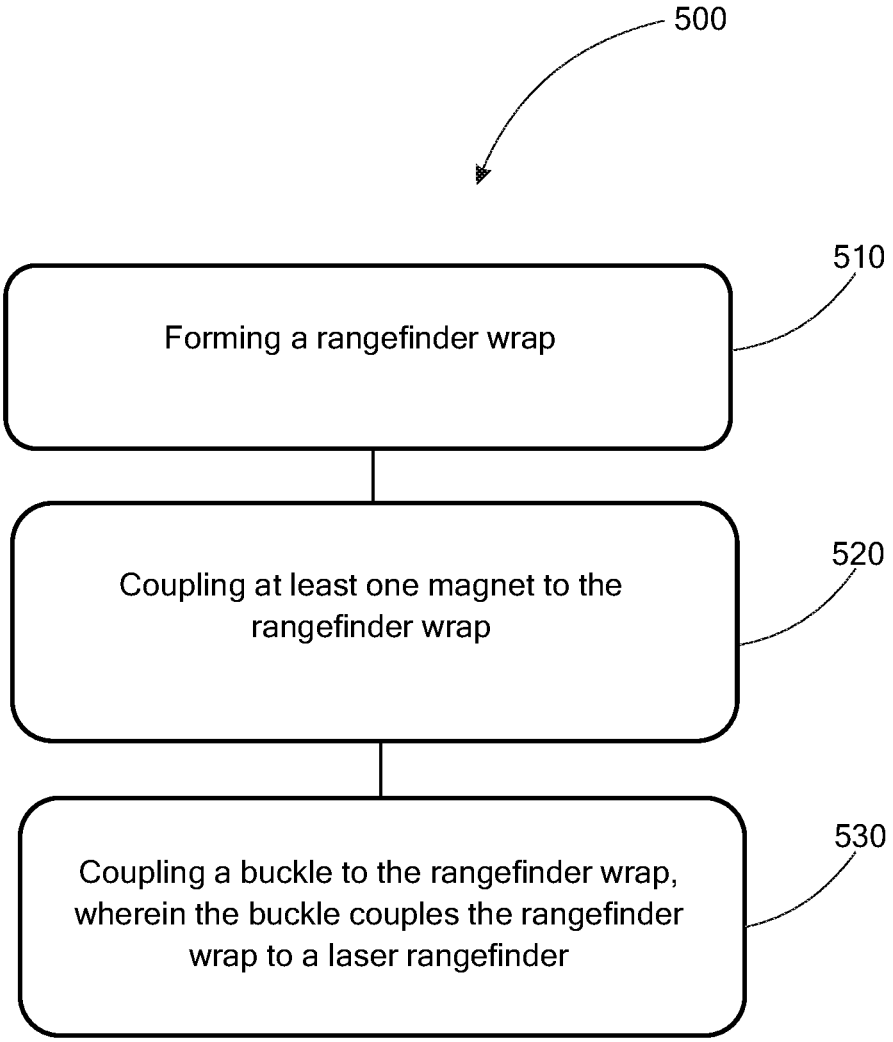
FIG. 11 illustrates a method of forming a laser rangefinder holder.

FIG. 11 illustrates a method 500 of forming a laser rangefinder holder. Method 500 includes an act 510 of forming a rangefinder wrap. Method 500 also includes an act 520 of coupling at least one magnet to the rangefinder wrap. And method 500 includes an act 530 of coupling a buckle ring to the rangefinder wrap, where the buckle ring couples the rangefinder wrap to a laser rangefinder. Method 500 can include many other acts.

In some embodiments, act 510 of forming a rangefinder wrap includes cutting a strip of flexible material. In some embodiments, the strip of flexible material includes an encircling portion and a foldover portion coupled to the encircling portion. In some embodiments, act 510 of forming a rangefinder wrap includes covering at least a portion of the encircling portion with a loop portion of a hook and loop coupler. In some embodiments, act 510 of forming a rangefinder wrap includes covering at least a portion of the foldover portion with a hook portion of a hook and loop coupler.

In some embodiments, act 510 of forming a rangefinder wrap includes cutting a strip of flexible material such that the strip of flexible material includes an encircling portion and a first and a second foldover arm, where the first and the second foldover arms extend parallel to a top edge of the encircling portion.

In some embodiments, act 510 of forming a rangefinder wrap includes cutting a strip of flexible material such that the strip of flexible material includes an encircling portion and a first and a second foldover arm, where the first and the second foldover arms extend perpendicular to a top edge of the encircling portion.

In some embodiments, act 520 of coupling at least one magnet to the rangefinder wrap includes capturing the at least one magnet between a magnet holder strip and the rangefinder wrap. In some embodiments, act 520 of coupling at least one magnet to the rangefinder wrap includes sewing the magnet holder strip to the rangefinder wrap. In some embodiments, act 520 of coupling at least one magnet to the rangefinder wrap includes gluing the magnet holder strip to the rangefinder wrap. In some embodiments, act 520 of coupling at least one magnet to the rangefinder wrap includes coupling the at least one magnet a distance of about 57 mm from the buckle ring.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

What is claimed is:

1. A laser rangefinder holder for removeably coupling a laser rangefinder to a metal surface comprising:

a rangefinder wrap comprising a strip of flexible material with a buckle end and a foldover end opposing the buckle end, wherein the laser rangefinder is operatively coupled by wrapping the rangefinder wrap around the laser rangefinder;

at least one magnet coupled to the rangefinder wrap, wherein the at least one magnet is configured to removeably couple the laser rangefinder holder to the metal surface; and a buckle ring coupled to the buckle end, wherein the rangefinder wrap comprises:

an encircling portion, wherein the encircling portion extends from the buckle end to a folding line, wherein the encircling portion is configured to wrap around the laser rangefinder;

and a foldover portion, wherein the foldover portion extends from the folding line to the foldover end, wherein the foldover portion extends through the buckle ring, folds back on itself and couples to the encircling portion configured to hold the laser rangefinder in the laser rangefinder holder, and wherein the metal surface is located on a golf cart.

2. The laser rangefinder holder of claim 1, wherein the buckle ring is removeably coupled to the buckle end.

3. The laser rangefinder holder of claim 1, further comprising a magnet holder strip, wherein the magnet holder strip couples the at least one magnet to the rangefinder wrap.

4. The laser rangefinder holder of claim 3, wherein the magnet holder strip is glued to the rangefinder wrap.

5. The laser rangefinder holder of claim 3, wherein the magnet holder strip is sewed to the rangefinder wrap.

6. The laser rangefinder holder of claim 1, wherein a loop portion of a hook and loop coupler covers at least a portion of an encircling portion front surface.

7. The laser rangefinder holder of claim 6, wherein a hook portion of the hook and loop coupler covers at least a portion of a foldover portion front surface.

8. The laser rangefinder holder of claim 1, wherein the foldover portion comprises a first foldover arm extending from the encircling portion and a second foldover arm extending from the encircling portion.

9. The laser rangefinder holder of claim 8, wherein the first and the second foldover arms extend parallel to an encircling portion top edge.

10. The laser rangefinder holder of claim 8, wherein the first and the second foldover arms extend perpendicular to an encircling portion top edge.

11. A method of forming a laser rangefinder holder for removeably coupling a laser rangefinder to a metal surface for a laser rangefinder, the method comprising:

forming a rangefinder wrap;

coupling at least one magnet to the rangefinder wrap; and coupling a buckle ring to the rangefinder wrap, wherein the laser rangefinder is operatively coupled by wrapping the laser rangefinder wrap around the laser rangefinder, and wherein the buckle ring couples the rangefinder wrap to the laser rangefinder, wherein the forming of the rangefinder wrap comprises:

cutting a strip of flexible material, wherein the strip of flexible material comprises:

an encircling portion; and a foldover portion coupled to the encircling portion, and wherein the metal surface is located on a golf cart.

12. The method of claim 11, wherein the forming of the rangefinder wrap comprises:

covering at least a portion of the encircling portion with a loop portion of a hook and loop coupler; and covering at least a portion of the foldover portion with a hook portion of a hook and loop coupler.

13. The method of claim 11, wherein the foldover portion comprises a first and a second foldover arm, wherein the first and the second foldover arms extend parallel to a top edge of the encircling portion.

14. The method of claim 11, wherein the forming of the rangefinder wrap comprises cutting a strip of flexible material such that the strip of flexible material comprises:

an encircling portion; and a first and a second foldover arm, wherein the first and the second foldover arms extend perpendicular to a top edge of the encircling portion.

15. The method of claim 11, wherein the coupling of the at least one magnet to the rangefinder wrap comprises capturing the at least one magnet between a magnet holder strip and the rangefinder wrap.

16. The method of claim 11, wherein the at least one magnet is at a distance of about 57 mm from the buckle ring.

* * * * *